US006796002B2

(12) United States Patent
Beckwith

(10) Patent No.: US 6,796,002 B2
(45) Date of Patent: Sep. 28, 2004

(54) UNIVERSALLY FITTING REMOVABLE PADDED WRAP-AROUND HANDLE COVER

(76) Inventor: Darla L. Beckwith, 7203 Bay Club Ct., Tampa, FL (US) 33607

( * ) Notice: Subject to any disclaimer, the term of this patent is extended or adjusted under 35 U.S.C. 154(b) by 0 days.

(21) Appl. No.: 10/052,389

(22) Filed: Jan. 23, 2002

(65) Prior Publication Data

US 2003/0135954 A1 Jul. 24, 2003

(51) Int. Cl.[7] ..... A45C 13/26
(52) U.S. Cl. ..... 16/422; 16/421; 16/110.1
(58) Field of Search ..... 16/421, 110.1, 16/DIG. 12, 422; 294/146, 149, 171, 25; 280/33.992, 33.993; 38/95; 81/487

(56) References Cited

U.S. PATENT DOCUMENTS

| | | | | | |
|---|---|---|---|---|---|
| 3,554,417 | A | * | 1/1971 | Yorty | 294/149 |
| 4,262,385 | A | * | 4/1981 | Norman | 16/411 |
| 4,805,937 | A | * | 2/1989 | Boucher et al. | 280/33.992 |
| 5,440,783 | A | * | 8/1995 | Allardyce et al. | 16/110.1 |
| 5,469,601 | A | * | 11/1995 | Jackson | 16/421 |
| 5,487,582 | A | * | 1/1996 | Bourgeois et al. | 294/146 |
| 5,511,445 | A | * | 4/1996 | Hildebrandt | 74/558.5 |
| 5,708,045 | A | * | 1/1998 | Thompson et al. | 521/174 |
| 5,715,571 | A | * | 2/1998 | Fasano | 16/436 |
| 5,738,401 | A | * | 4/1998 | Fan | 294/171 |
| 5,867,868 | A | * | 2/1999 | Ward | 16/422 |
| D411,093 | S | * | 6/1999 | Selig et al. | D8/321 |
| 6,006,403 | A | * | 12/1999 | Battiato | 16/421 |
| 6,049,948 | A | | 4/2000 | Leonardi | |
| 6,056,344 | A | | 5/2000 | Forsythe | |
| D442,085 | S | | 5/2001 | Bozlee | |
| D448,663 | S | | 10/2001 | Raftree | |
| 6,378,925 | B1 | * | 4/2002 | Greenlee | 294/171 |
| 6,481,771 | B1 | * | 11/2002 | Friedman | 294/171 |
| 6,543,794 | B1 | * | 4/2003 | Tyree | 280/33.992 |

* cited by examiner

*Primary Examiner*—Chuck Y. Mah
*Assistant Examiner*—Michael J. Kyle
(74) *Attorney, Agent, or Firm*—Melvin K. Silverman; Yi Li

(57) ABSTRACT

A universally fitting, removable padded wraparound luggage handle cover includes a substantially square and planar interior sheet of a cushioning, preferably foam-like material. About the cushioning material is peripherally secured a top and a bottom sheet of a flexible high woven fabric. To the top sheet of the fabric is secured an elongate strip of hook-and-loop material having a width in a range of about 1 to about 3.5 centimeters and secured to the top sheet along one entire edge thereof. A second or bottom strip of hook-and-loop material, generally complemental in width to the top strip, is secured to the bottom sheet of fabric along an edge opposite to the edge at which the top strip, is secured and in which the respective fabric edges define a distance therebetween in a range of about 12 to about 17 centimeters. The bottom sheet of fabric is preferably provided with a transparent envelope having one free edge into which may be inserted owner identification or other information. The thickness of the inventive removable wraparound handle cover is at its maximum when the hook-and-loop strips are secured to each other so that the entire handle cover assumes the geometry of an annular solid ellipsoid. In such condition, the strip defines a maximum thickness of the structure of about one centimeter. The strips and cushioning define an elongate zone of maximum thickness of the inventive handle cover that may be readily positioned by the user to protect a part of the hand or fingers that is most susceptible to pain or fatigue.

12 Claims, 10 Drawing Sheets

UNIVERSALLY FITTING REMOVABLE PADDED WRAP-AROUND HANDLE COVER

BACKGROUND OF THE INVENTION

A. Field of Invention

The instant invention relates to means for the improved gripping of handles of luggage and cases to protect the user's hand from unequal and damaging pressures during the lifting and carrying thereof.

B. Related Prior Art

Considerable recognition exists in the prior art of a need for temporary handles to assist in the carrying of plastic shopping bags of a type generally used by grocery and department stores. Such bags are fabricated of a flexible plastic film and are formed of thin plastic film in which webs are provided as handles, one upon each side of the top of the bag opening. Such handles of plastic bags are uncomfortable to grasp, particularly when heavy articles are placed therein. While the strength of plastic bags is beneficial to the retail establishment, the web-like handle portions thereof rapidly acquire the effect of a string or wire which digs or cuts into the user's hands and/or fingers, thus becoming painful within a short period of time. The prior art has recognized these problems associated with flexible plastic film shopping bags and has suggested a number of solutions thereto including, particularly, U.S. Published Specification 2001, 0000938 A1 to Bozlee, entitled Device And Method For Advertising And Carrying Bags With Handles; U.S. Pat. No. 5,748,401 (1998) to Fan, entitled Detachable Shopping Bag Hand Grip Having Central Section Surrounded With Softer Outer piece With Slot Into Which Handle May Be Clipped; U.S. Pat. No. 6,056,344 (2000) to Forsyth, entitled Handle For Bags; U.S. Pat. No. 5,487,582 (1996) to Bourgeois, et al, entitled Detachable Shopping Bag Handle; U.S. Pat. No. 6,049,948 (2000) to Leonardi, entitled Handle For Carrying A Bag; and U.S. Design Pat. No. 411,093 (1999) to Salig, entitled Drop Around Padded Handle, and Des. No. 448,663 (2001) to Raftree, Entitled Plastic Bag Carrying Handle.

All of the above referenced patents relate to a selectably attachable and detachable wraparound plastic bag handle cover. Only said reference to Bourgeois indicates additional utility with respect to other types of shopping bags, namely, paper and fabric shopping bags, the handles of which are therefore cord or fabric-like in character. What therefore is noticeably absent in the prior art is a removable wraparound handle cover for handles of luggage and other containers, having handles substantially of the type of luggage handles, these including, without limitation, sports bags, gym bags, duffel bags, golf bags, bowling bags, coolers, tool boxes, and attaché bags and cases. While such articles do not give rise to the immediate wire-like effect of digging or cutting into the user's hands or fingers, as above described, the long term effect thereof can be equally, if not more, harmful to one having frequent occasion to carry such luggage and articles having handles which are anatomically similar in their effect on the human hands and fingers as luggage handles. More particularly, a state of the art luggage handle consists of an elongate, often convex, element having a length of about 21 centimeters, dependent upon the degree of convexity relative to the upper surface of the piece of luggage to which it is attached. Such a curved handle will cover a linear distance of at least 17 centimeters from end-to-end (as is more fully described below). Further, a radial cross-section of a handle of most state-of-the-art luggage, toolboxes and the like exhibit a substantially ellipsoidal radial cross-section, that is, in a direction transverse to the handle length. This ellipsoidal cross-section may be either uniform or may vary slightly relative to the points of securement of the handle to the luggage surface. However, the radial cross-sectional ellipse of such handles will define a ratio of major axis to minor axis of approximately 3 to 1. Further, the typical circumference or periphery of most such handles is approximately 7.5 to 8.5 centimeters. This corresponds to the anatomically established fact that the ideal circumference for griping or engagement by the hand of an adult human is approximately 8 centimeters. Therefore, depending upon the particular type of article to which the handle is attached, a radial cross-sectional geometry thereof may run the gamut from an exact circle, as would be typical in the case of ice coolers, to that of a rigid handle or flexible strap having the above referenced ratio of 3-to-1 of length of major-to-minor axis. Accordingly, notwithstanding the degree of circularity, flatness or directionality of the radial cross-section of the handle, the anatomy of the human hands dictates that the periphery of such radial cross-section shall fall within a range of about 7.5 to 8.6 centimeters, that is, a smaller circumference will not permit the user to apply maximum strength and force to the handle, while a greater circumferential dimension will render it difficult to grasp the entire handle, thereby increasing the chance of slippage out of the hand of the user.

The grippage of such handles of luggage and luggage equivalents has been a longstanding problem, particularly for persons suffering from arthritis of the hand or fingers, and persons having less than normal strength or ability to carry luggage or bags having more than a particular weight, as is commonly the case with people that are frail, ill or of advanced age.

The experience of the prior art, as above described, relative to carrying handles for plastic bags has demonstrated the importance of an appropriate padded or cushioned handle for the absorption of pressures and the distribution of weight and force directed to a single line, across a wide possible area, to reduce discomfort in the carrying of bags. In medical terms, the distribution of force and pressure across the widest possible area is necessary to minimize traction and stress at the joints of the fingers, hand, and wrist. These principles, which are known in the art, have however not found expression in the area of covers for handles of luggage and related articles.

One apparent obstacle to the development of a viable luggage handle cover has been the lack of uniformity of the cross-sectional geometry, length, and width of such handles, this in combination with the fact that certain luggage manufacturers have attempted to incorporate into the handle itself a permanent padded cover somewhat resembling that taught in said U.S. Pat. No. 5, 487,582 to Bourgeois, et al, recited above. However, for many arthritis sufferers and senior citizens, the mere addition of a layer of leather about a luggage handle having hard and/or sharp edges is not a sufficient solution. Also, the variation in shape of such handles has been a further problem in the development of a universally-fitting removable padded wraparound luggage handle cover. Therefore, even those references bearing some similarity of external appearance to the instant invention, i.e., said references to Raftree and Bourgeois, do not teach an article having substantially universally application to essentially all types of single and double rigid and semi-rigid handles associated with luggage, toolboxes, coolers, duffel bags, and various other types of containers capable of being loaded with contents of considerable weight. The present invention thereby addresses this long felt need in the art and, as well, functions to improve the stability of the handle itself when it is grasped. Further, the instant invention provides a platform or medium usable for purposes of personal identification and/or promotion of a business or social entity, including a church or fan club that may provide the inventive article to its customers, members or fans.

BRIEF SUMMARY OF THE INVENTION

A universally fitting, removable padded wraparound luggage handle cover includes a substantially square and planar interior sheet of a cushioning, preferably foam-like material having a thickness of about 2 to 6 mm and a density of about 10 to 20 mg/cc. About said cushioning material is peripherally secured a top and a bottom sheet of a flexible high venier woven fabric. To said top sheet of fabric is secured an elongate strip of hook-and-loop material having a width in a range of about 1 to about 3.5 centimeters and secured to said top sheet of said fabric along one entire edge thereof. A second or bottom strip of hook-and-loop material, generally complemental in width to said top strip, is secured to said bottom sheet of fabric along an edge thereof opposite to said edge at which said top strip, is secured and in which said respective fabric edges define a distance therebetween in a range of about 12 to about 17 centimeters wherein about 15 centimeters comprises the best mode known to the inventor. Said bottom sheet of fabric is preferably provided with a transparent envelope having one free edge into which may be inserted owner identification or other information. The thickness of the inventive removable wraparound handle cover is at its maximum when said hook-and-loop strips are secured to each other so that the entire handle cover assumes the geometry of an annular solid ellipsoid. In such condition, said strips define a maximum thickness of the structure, of about one centimeter. Said strips thus define an elongate zone of maximum thickness of the inventive handle cover that may be readily positioned by the user to protect that part of the hand or fingers that are most susceptible to pain or fatigue.

It is accordingly an object of the invention to provide a wraparound handle cover, or wrap for handles of luggage and the like, which is universally fittable upon any handle of any type of luggage or luggage equivalent.

It is another object to provide a removable wraparound handle of the above type which is operative to absorb and distribute pressure over the entire length of the hand of the user that is gripping a handle of a piece of luggage, while also providing enhanced stability between the hand and the handle.

It is a further object of the invention to provide a means of the above type having general properties of absorption and distribution of pressure and having an enhancement of such absorption along an adjustable region thereof running transverse to the longitudinal axis of the human hand.

It is another object to provide a handle cover of the above type which may also be adorned with graphic materials of interest to the user or the public, thereby service as a luggage identifier at airports and the like.

It is a still further object to provide a handle cover of the above type that may be used as a medium of personal or social expression by its users or which may be used as a cost-effective medium for advertising capable of reaching large audiences.

It is a yet further object of the invention to provide a handle cover of the above type to protect the hands of the user from heavily loaded luggage, which is durable and reliable in operation and which, in the case of a multi-handled bag, locks the handles thereof into a closed position so that the contents thereof do not fall out or that undue stress in not placed upon any zippers associated with the luggage.

It is a still further object to provide a handle cover of the above type which is simple and convenient in its use and cost-effective in its manufacture.

The above and yet other objects and advantages of the present invention will become apparent from the hereinafter-set forth Brief Description of the Drawings, Detailed Description of the Invention and Claims appended herewith.

DETAILED DESCRIPTION OF THE INVENTION

Figure 1:
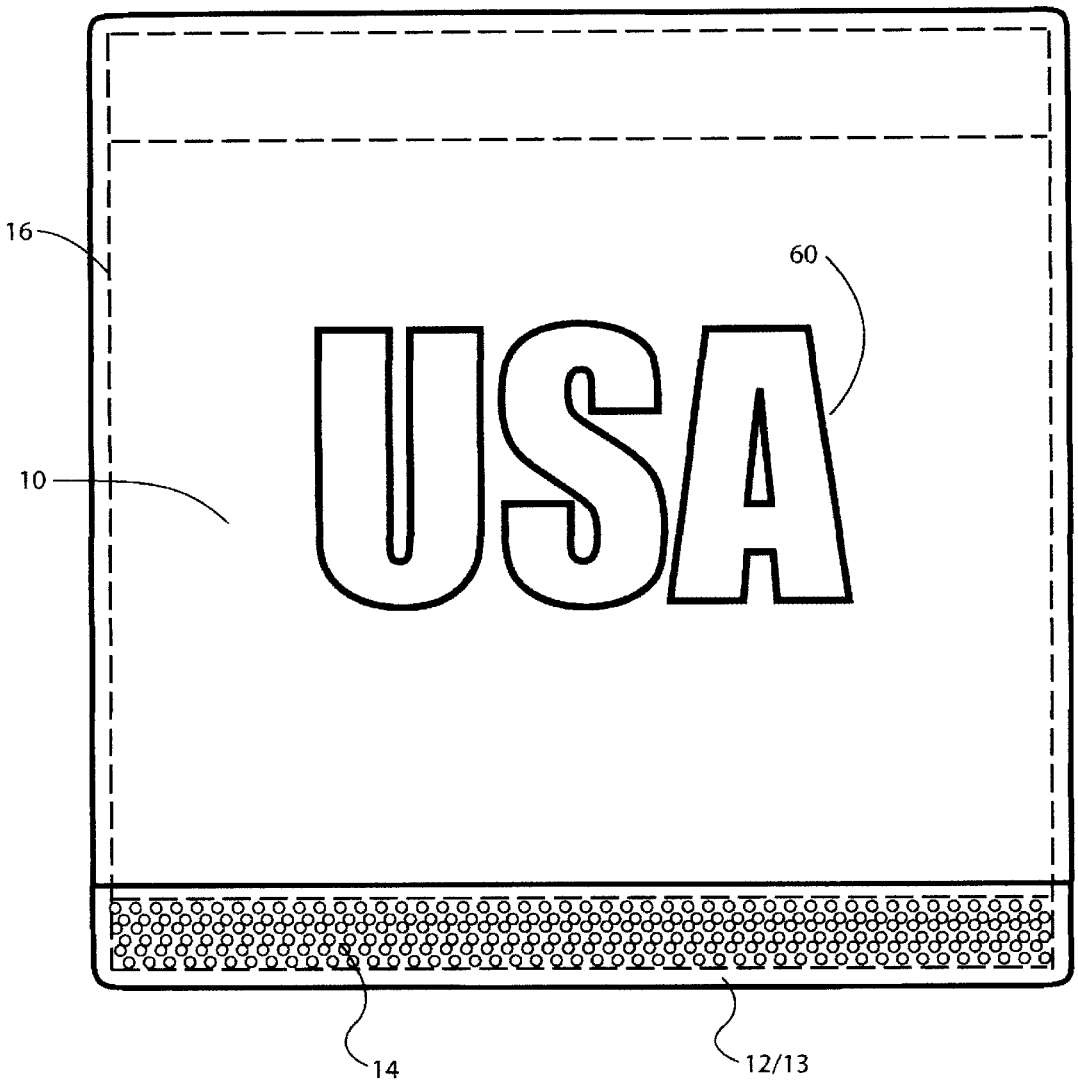
FIG. 1 is a top schematic view of the inventive handle cover.

With reference to the schematic plan view of FIG. 1, the instant universally fitting, removable padded wraparound handle cover may be seen to include a top sheet 10 of a flexible woven fabric including, without limitation, a polyester venier canvas (i.e., 600 threads per lineal inch), cotton, velour, nylon, vinyl, and leather, each sheet preferably exhibits edges in a range of about 12 to about 17 centimeters and, in a preferred embodiment thereof, about 15 centimeters. Along a first edge 12 is provided a strip of a hook-and-loop material (commonly known as VELCRO) 14 which, typically, exhibits a width in a range of about 1 to about 3.5 centimeters having a longitudinal edge 13 thereof disposed complementally to said edge 12 of said top sheet of 10 of the inventive article. As may be further noted in FIG. 1, the article includes stitching 16 which secures all of the peripheral edges of the fabric to said hook-and-loop strip 14 and to the other components of the article as are more fully set forth below. On said top sheet may be imprinted a graphic 60.

Figure 2:
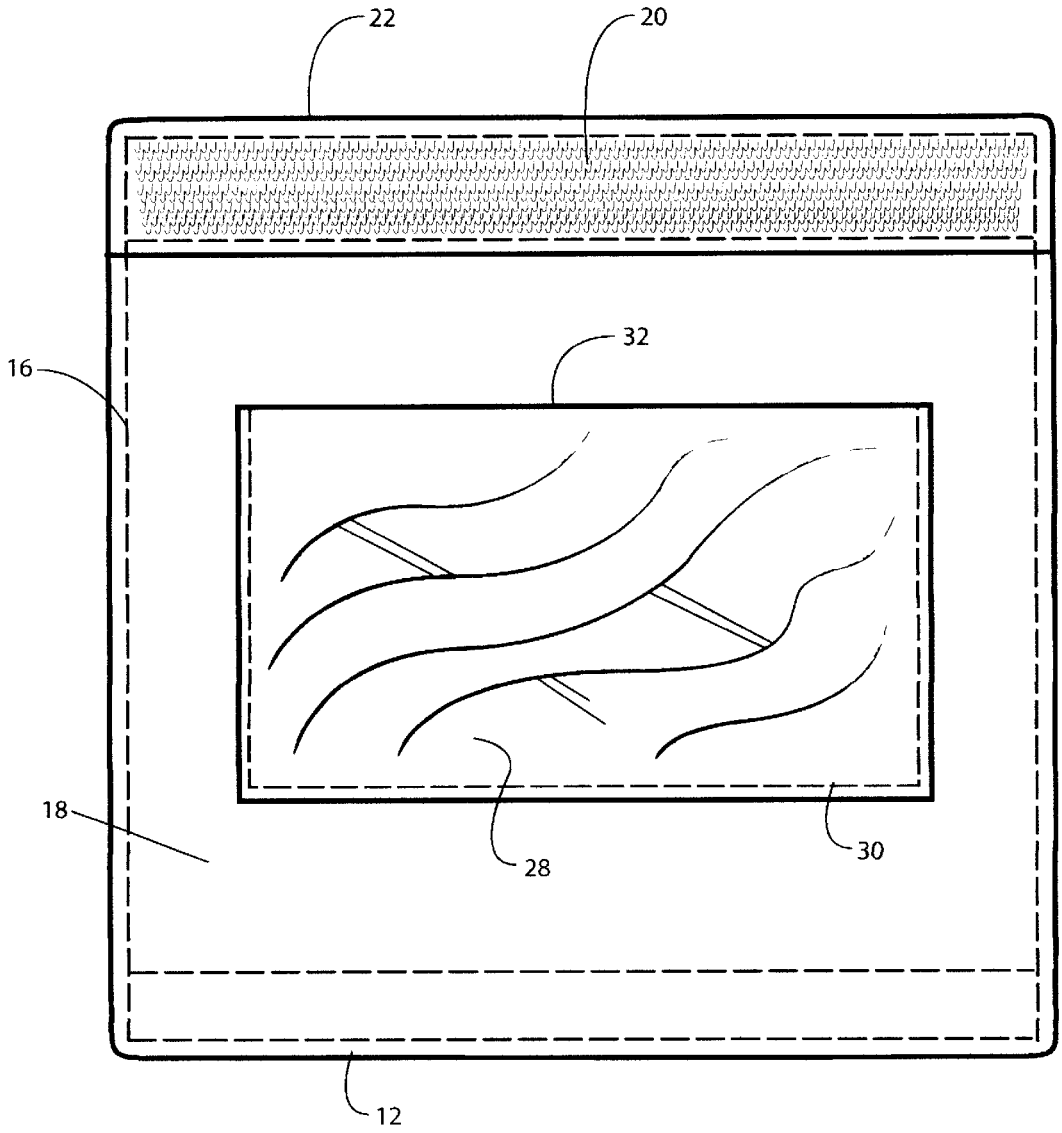
FIG. 2 is a bottom schematic view thereof.

In FIG. 2 is shown a bottom sheet 18 formed of a like or similar material to that of said top sheet 10. Said bottom sheet includes a strip 20 of hook-and-loop material along an edge 22 of said bottom sheet 18 having substantially, but not necessarily the same width as said strip 14. As may be further noted, said edge 22 is opposite to said lower edge 12 of top sheet 16 above described with reference to FIG. 1. By virtue of the location of stitching 16, it may be appreciated that all components of the article are stitched together. These components preferably include a transparent envelope 28, which may be formed of a material such as a clear vinyl which, through the use of a second form of stitching 30, is attached to said bottom sheet 18 at three sides thereof, thus leaving a single free edge 22 into which may be inserted any of a variety of identifying information as, for example, the name and address of the owner of the luggage handle cover.

Figure 3:
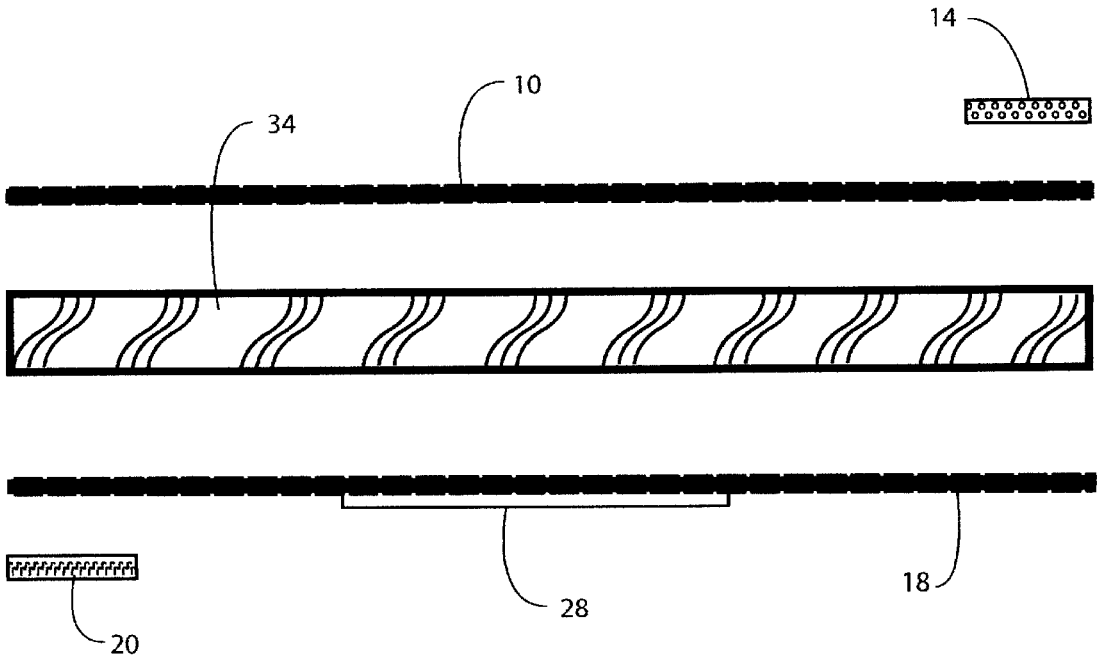
FIG. 3 is an exploded view showing all components of the inventive article.

In the exploded view of FIG. 3 may be seen each of the above described components of the inventive article and, in addition, a substantially square, substantially planar interior layer 34 of cushioning material, which is preferably foam-like in character. A suitable such material is a flexible polyurethane foam such as a polyester based urethane having a density of about 12 to 20 mg/cc and an uncompressed thickness of between about 2 and about 7 mm. Said cushioning material is characterized by its ability to absorb and distribute pressure and its capacity to deform relative to areas thereof are subject to pressure which, as is described below, occurs when the present handle cover is employed with the handle of a piece of luggage or analogous article of the types above set forth in the Background of the Invention. Accordingly, the inherent properties of such a foam-like cushioning material will conform to the geometry of the fingers and hand of the user, thereby providing enhanced stability of grip to the user as well as absorbing pressure caused by the weight of the luggage, and distributing this pressure across a wide area approaching of the greatest width of a normal adult human hand, i.e., 8 to 11 centimeters.

Figure 4:
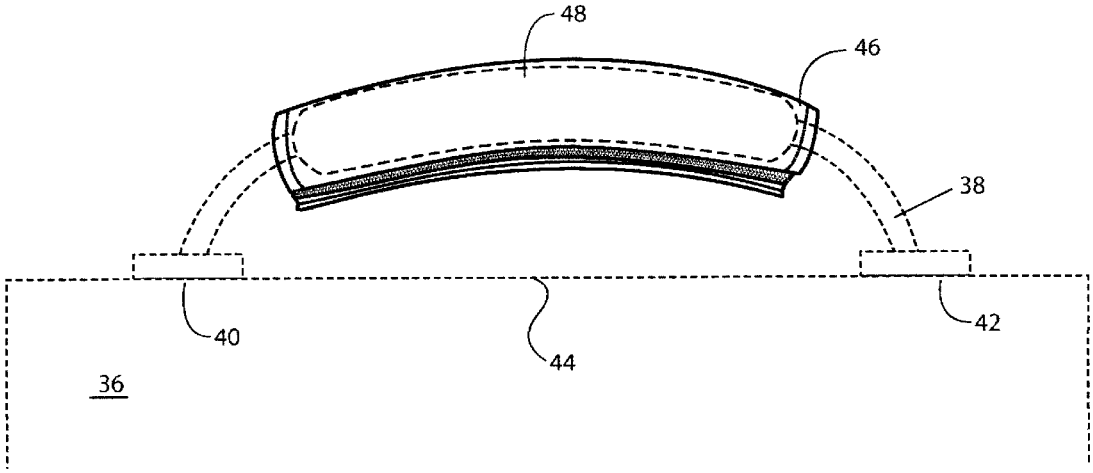
FIG. 4 is a side perspective operational view showing the manner of attachment of the inventive handle cover about the handle of a piece of luggage.
Figure 5:
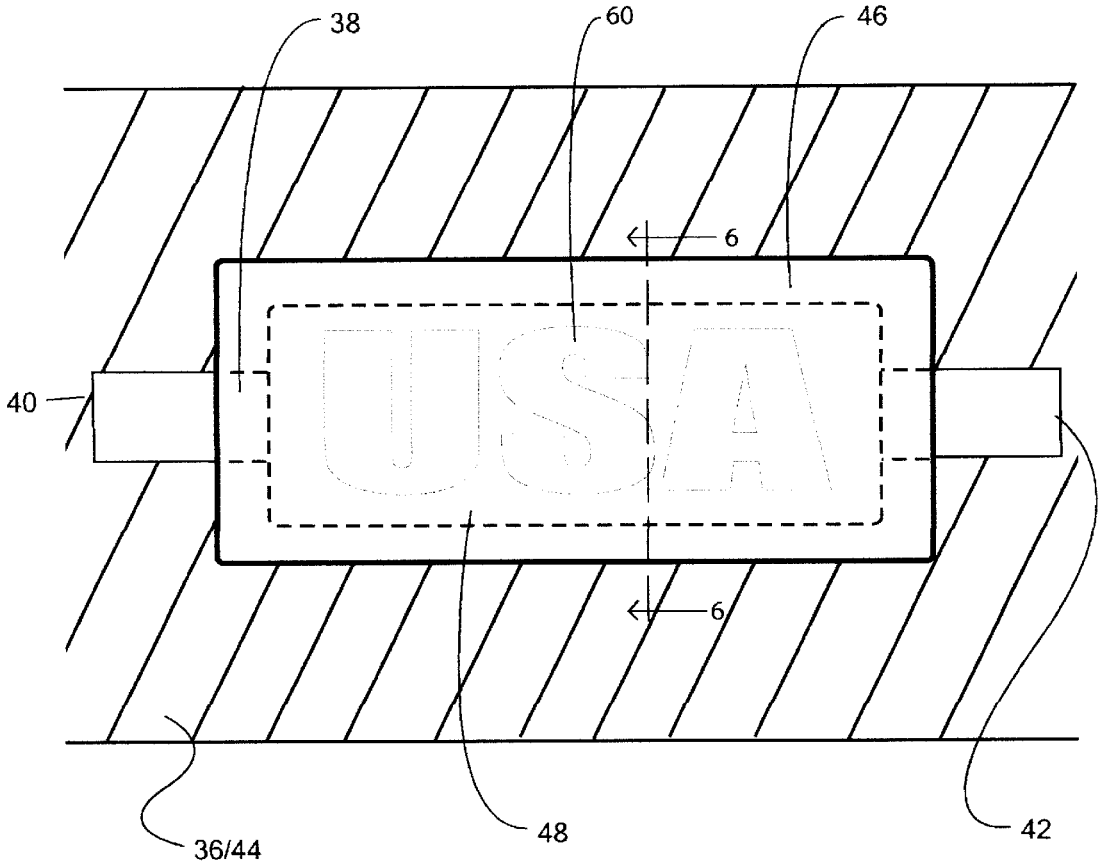
FIG. 5 is a top plan view of FIG. 4.

The dimensions of cushion sheet 34 are substantially complemental to those of said upper and lower fabric sheets 10 and 18 and, at a typical dimension of 15 centimeters per edge thereof, provides sufficient range for engagement by a hand of any size while also having sufficient size to sufficiently engage the handle of all known handles of all luggage and luggage equivalents such as toolboxes, water coolers, and the like. This aspect of dimensionality relative to luggage handles is schematically shown in the sketches of FIGS. 4 and 5. Therein is shown a piece of luggage 36, luggage handle or carrying strap 38 thereof, and the surfaces 40 and 42 of securement of said handle or strap to the luggage 36. It, as noted above, has been determined that a typical length of handle or strap 38 is about 21 centimeters if curved, and is about 17 centimeters if co-parallel with surface 44 of luggage 36. In either case, the range of edge size of about 12 to about 17 centimeters of the inventive luggage handle holder 46 is such that it will fit onto any type of luggage handle, whether rigid, flexible, curved, vertical co-parallel with surface 44, or a dual handle requiring engagement of both parts thereof by the user. These relationships may also be noted with reference to FIG. 5 which is a top plan view of the view of FIG. 4.

Further shown in FIGS. 4 and 5 is a reinforced typically leather sleeve section 48 of handle 38, which is often provided in contemporary luggage to add comfort and stability in gripping of the piece of luggage. However, for the many reasons set forth in the Background in the Invention above, the mere addition of a sleeve of leather to the center of a handle is not sufficient to materially address the anatomical problems associated with existing luggage handles of whatever type. Further, sleeve 48 comprises a permanent part of handle 38 and, as such, does not offer any of the non-anatomical advantages associated with the present invention, (see objects of the invention above) and may actually render the luggage more difficult to grasp for one having small hand.

With reference to a radial cross-sectional view taken along Line 6—6 of FIG. 5, a common ellipsoidal cross-section of luggage handle 38 may be seen, that is, an ellipse having a ratio of major axis a to minor axis b of approximately 3 to 1. As above noted, the instant invention is not limited to such cross-sectional geometries but, rather, may be advantageously used with any luggage handle having a radial circumference or periphery in a range of about 6 to 9 centimeters, this inclusive of luggage having a major vertical axis, and dual handle luggage which, in aggregate, exhibits such a cross-sectional dimension at the circumference thereof. With further reference to the view of FIG. 6, the inventive article may be seen in its operational position relative to said handle 38. That is, upper hook-and-loop strip 14 has been aligned with lower hook-and-loop means 20, such that inner surface 18 is in substantial contact with sufficient parts of surface 50 of handle 38 to maintain stability relative thereto. Such is the case even if major axis a of handle 38 is vertical, as opposed to horizontal, as is the case in types of older luggage and in certain non-luggage handles with which the inventive article may be employed. In all applications, it has been discovered that the resulting interior circumference of bottom sheet 18, upon alignment and mutual securement of respective hook-and-loop strips 14 and 20, sufficiently engage surface 50 of handle 38 to preclude movement or slippage relative thereto, when the inventive article 46 has been engaged by a hand 52 and fingers 54 of the user.

Figure 6:
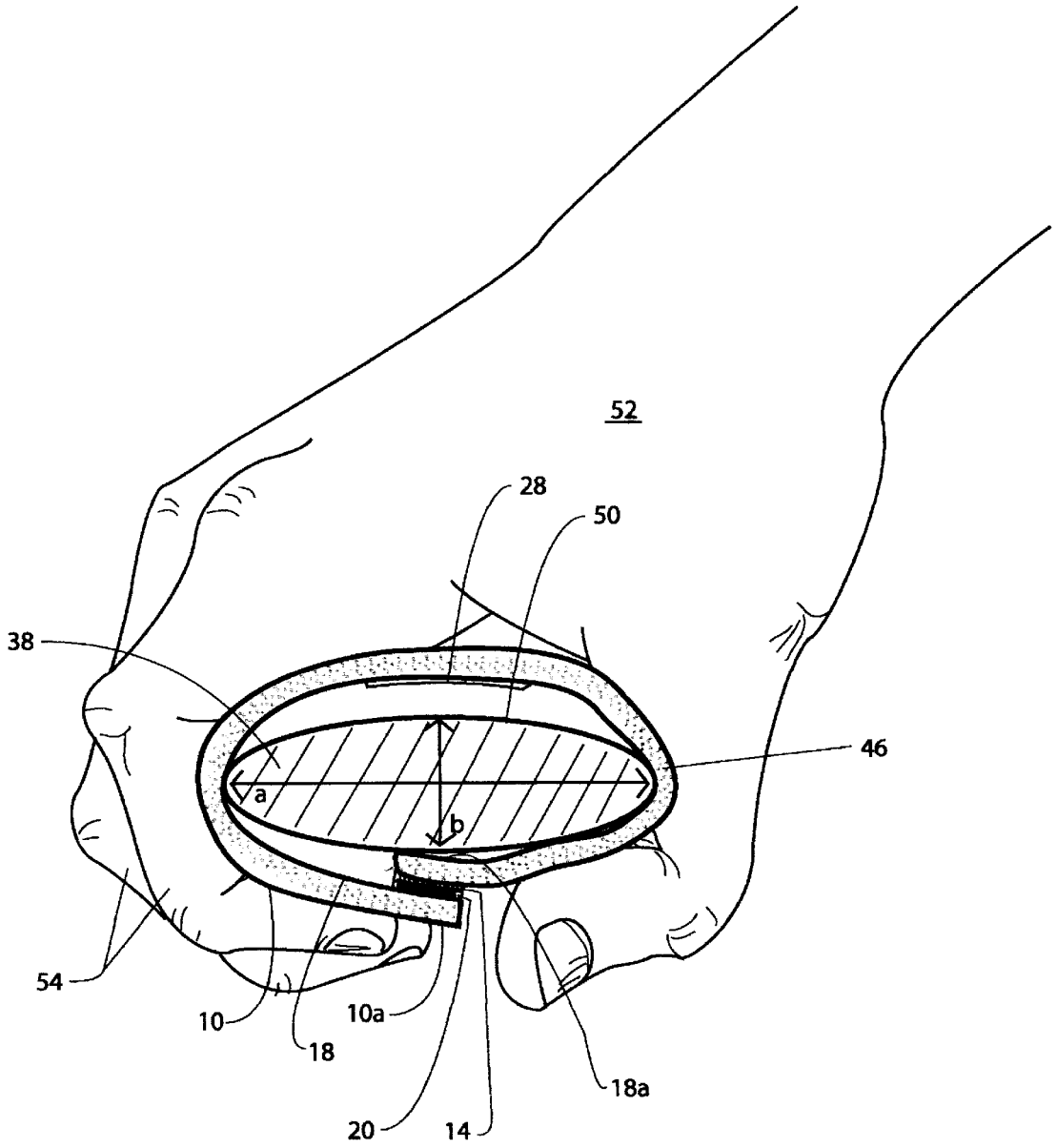
FIG. 6 is a radial cross-sectional view taken along Line 6—6 of FIG. 5, showing the inventive article positioned relative to a luggage handle in a fashion to maximize protection of the middle and end of the fingers of a user.

In FIG. 6 may be further noted that an additional and important benefit of the inventive article is obtained when a user wishes to provide enhanced protection relative to a particular afflicted part of the hands or fingers. For example, one having arthritis particular to outer joints of the finger 54 will position the article 46 in the manner shown in FIG. 6, that is, with the area of interface or overlap of about 2 cm of hook-and-loop strips 14/20 pointing downward to thereby provide to such joints of the finger a combined effect of multiple layers of cushioning (see also FIG. 9) and therefore distribution of pressure. These layers are area 18*a* of bottom fabric sheet 18, the cushioning layer 34 between surface 18*a* and top hook-and-loop strip 14, bottom hook-and-loop strip 20, cushioning layer 34 and area 10*a* of fabric sheet 10. As a result, two cushioning layers 34 and two hook-and-loop strips provide a maximum cushioning along the area defined by the width of the strips 14 and 20 and, thereby, maximum absorption and distribution of otherwise harmful forces and pressure to the fingers of the user.

Figure 7:
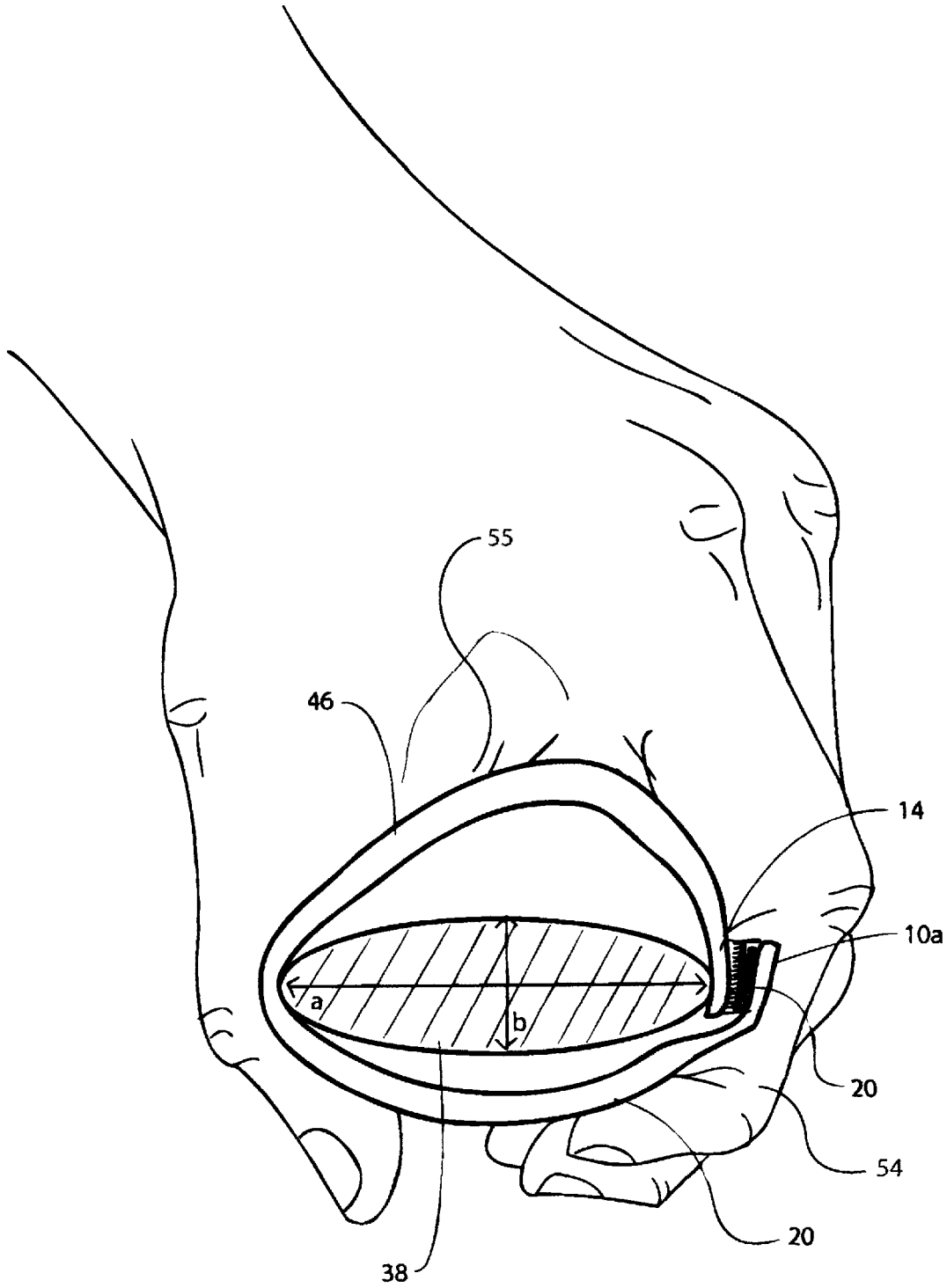
FIG. 7 is a radial cross-sectional view similar to the view of FIG. 6, however showing the inventive article positioned to provide maximum protection of the lower part of the fingers and the palm of the user.

In the event that the afflicted area of a user is more to the middle of the hand, that is, at the upper part of the fingers 54 and part of the palm 55 in which the fingers begin, one may place the inventive handle cover 46, relative to handle 38, in the position shown in FIG. 7. Therein, the above-described region of interface between the respective strips 14 and 20 will provide maximum protection to the central portion of the hand.

Figure 8:
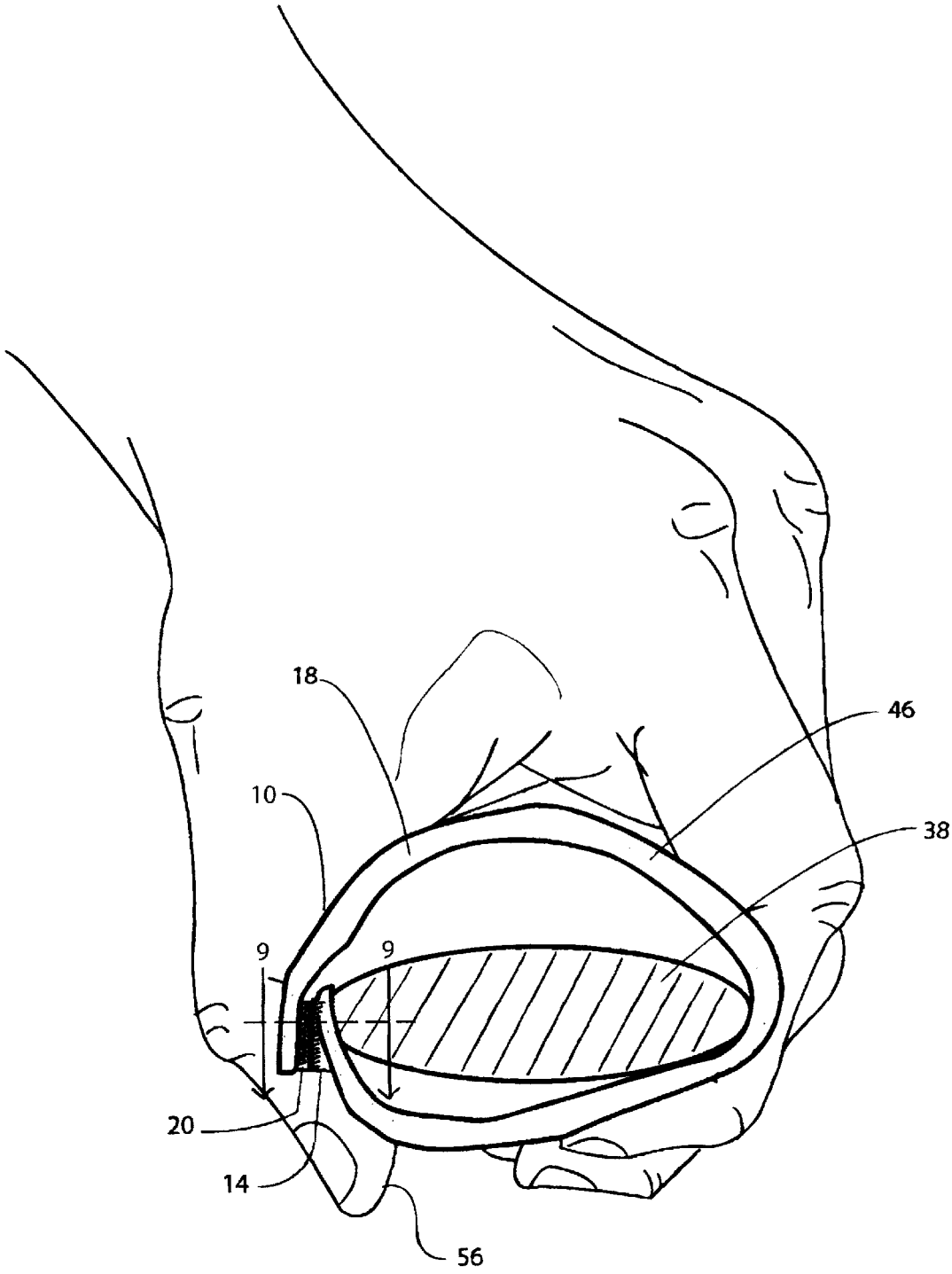
FIG. 8 is a radial cross-sectional view similar to the view of FIG. 6 in which the zone of overlap of the hoop and loop strips of the inventive articles is rotated to provide maximum protection to the thumb of the user.
Figure 9:
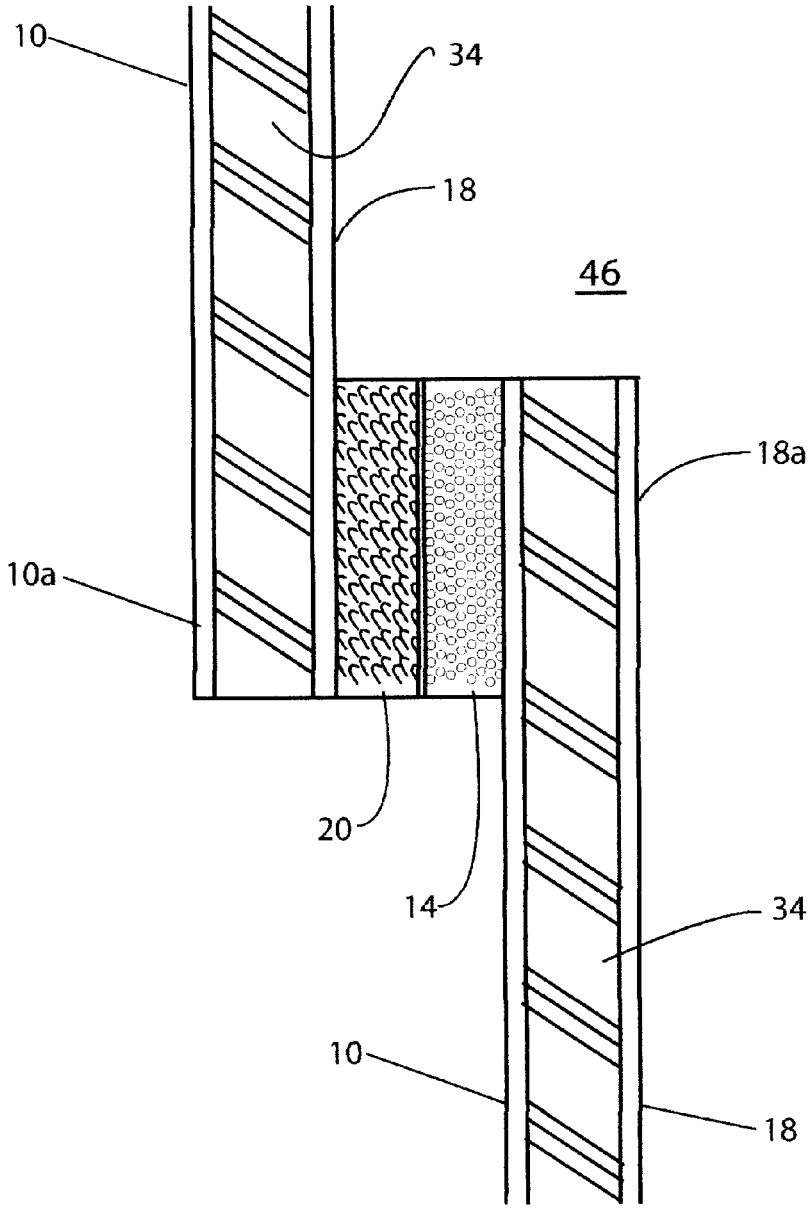
FIG. 9 is an enlarged cross-sectional view taken along Line 9—9 of FIG. 8.

In the event that a problem exists with one's thumb 56 or joints associated therewith, the handle cover 46 may be positioned in the manner shown in FIG. 8 to thereby provide maximum protection to the joints associated with the thumb of the hand. FIG. 9 is an enlarged cross-sectional view taken along Line 9—9 of FIG. 8, showing the zone of maximum cushioning.

Figure 10:
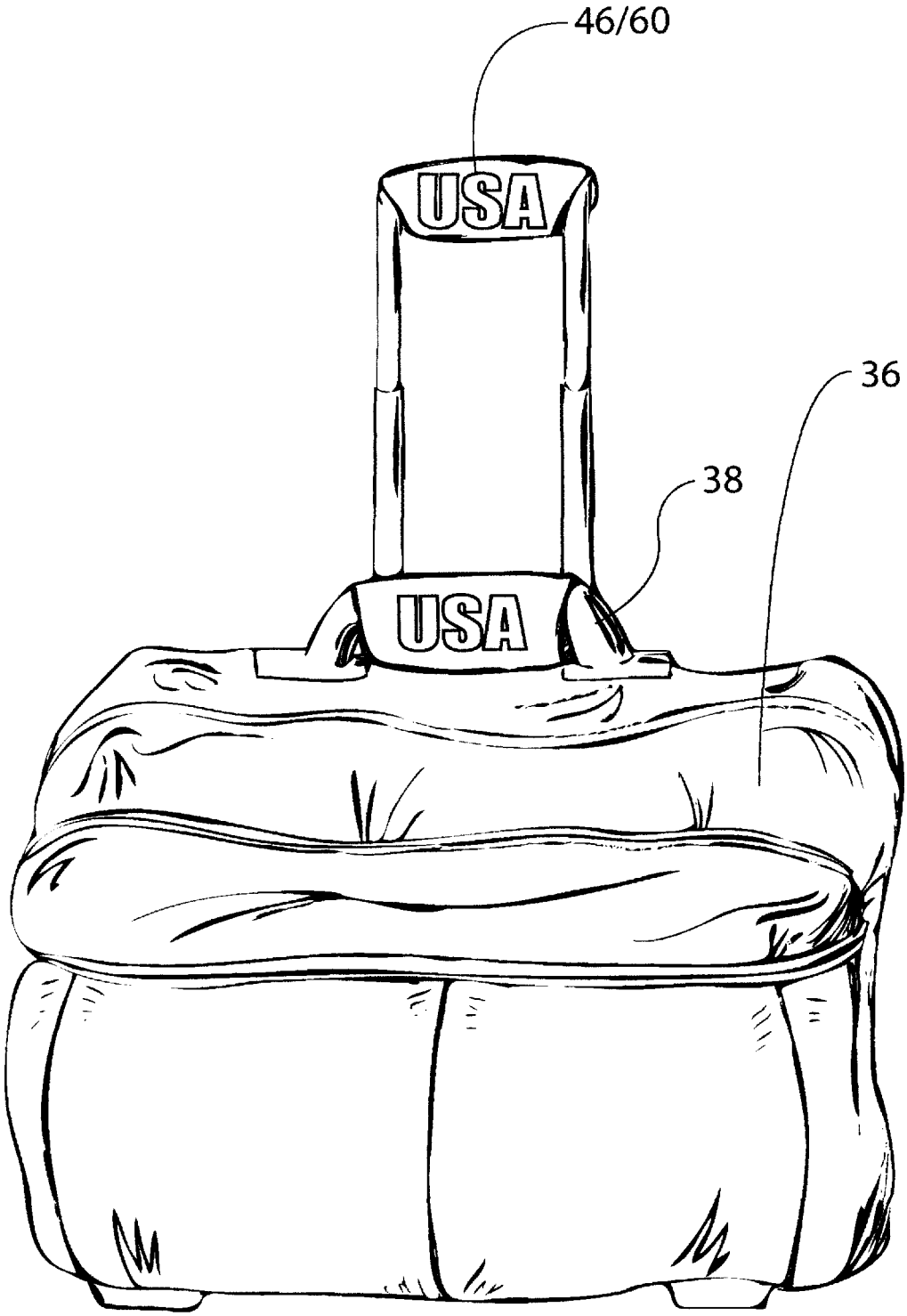
FIG. 10 is a perspective view of two of the inventive articles used upon a piece of luggage having two different types of handles associated therewith.

In FIG. 10 is shown the inventive article 46 attached to various types of handles 38 of a piece of luggage 36.

Therefrom, it may be appreciated that a logo or graphic 60 (see also FIG. 1) may be printed, embroidered, silk screened, or otherwise furnished to top sheet 10 of the inventive article to thereby provide a convenient means of luggage identification, notice of cultural affiliation, advertising space, or simply a medium upon which an artistic expression, i.e., a miniature painting may be applied. Accordingly, the invention, in addition to its significant anatomical benefits for many individual, can also be economically justified as a "give-away" item by various commercial and social entities wishing simply to promote a product, organization, or belief system, by giving away the inventive luggage handle cover to selected members of the public. This use of the instant invention may take innumerable forms including, without limitation, use of trade shows, business meetings, Christmas gifts, solicitation of prospective customers, notice of upcoming events, company identification, product awareness, walkable advertisement (as are now common with logos and names placed upon athletic wear), golf bags, sporting bags, and any other type of totes, this is an alternative to the providing of a business card to a prospective customer. Further, due to the amenability of the canvas-like fabric of sheets 10 and 18 to silk screening, bright graphics and purely artistic expression may be printed or otherwise affixed thereto, this thereby serving a function as a "luggage identification" means when the inventive removable wraparound handle cover is upon a piece of luggage at the time that one is attempting to locate luggage upon an arrival carousel at an airport. These uses are, of course, in addition to the primary use of the present article, namely, a means for alleviating the stresses, pain, and potential injury associated with the carrying of heavy bags and containers of numerous types.

It is to be further noted that the inventive handle cover 46 may be reversed such that logo 60 is on the inside of the structure and identification window 28 in on the outside. As such, the views of FIGS. 6–9 show the inventive cover in both modes. When so reversed, another logo may be inserted within window 28 to provide two types of logos to the cover.

Finally, the inventive handle cover 46 may be used in various other areas including padding for hand grips of crutches, wheelchair handles, walkers for the elderly, baby walkers, baby carriers, handlers of dog leashes, handles of pet carriers.

Further, the inventive structure may be readily provided with a zipper or hook-and-loop pouch within which to carry any small item such as a key or pet treat.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus my invention, what I claim as new, useful, and non-obvious and, accordingly, secure by Letter Patent of the United States is:

1. A universally fitting removable padded wrap-around container handle cover, comprising:

(a) a substantially square and planar interior layer of resilient cushioning material having an uncompressed thickness of between about 2 to about 7 millimeters sufficient to conform to the geometry of fingers and hand of a user to provide enhance stability of grip and to distribute the pressure across an area having a width of a normal adult human hand;

(b) a top and a bottom sheet of a flexible fabric, each sheet being substantially square and planar complementary to the shape of the cushioning material and each sheet being peripherally secured to each other with said cushioning material secured at least peripherally therebetween;

(c) a top strip, comprising pressure actuated securement and detachment means, having a width of about 1 to about 3.5 centimeters secured to said top sheet of fabric along one entire edge thereof;

(d) a bottom strip, also comprising pressure-actuated securement and detachment means, generally complemental in width to said top strip, said bottom strip secured to said bottom sheet of fabric along an edge thereof opposite to said one edge at which said top strip is secured, in which said respective sheets edges define a distance therebetween of between about 12 to about 17 centimeters; and (e) a transparent envelope of a rectangular shape having a long side and a short side, secured at three edges thereof to said bottom sheet with said long side of said envelope being aligned in parallel with said top and bottom strips, thereby providing one edge thereof into which may be inserted an identification or notice of a type desired by a user.

2. The handle cover as recited in claim 1, in which edges of said top and bottom sheets transverse to said edges associated with said securing strips define a distance therebetween of about 12 to about 17 centimeters.

3. The handle cover as recited in claim 2, in which a thickness of an entirety of said cover taken transversely through a plane of overlap of said respective securing strips, when secured to each other, defines a thickness of about 1 centimeter.

4. The handle cover as recited in claim 2, in which said flexible fabric comprises a polyester denier in a range of between about 400 to about 800.

5. The handle cover as recited in claim 2, in which said cushioning material comprises a polyurethane foam.

6. The handle cover as recited in claim 2, in which each of said press-actuated securement means comprise hook-and-loop means.

7. The handle cover as recited in claim 5, in which each of said press-actuated securement means comprise hook-and-loop means.

8. A multi-functional luggage handle cover comprising:

(a) a substantially square and planar interior layer of resilient cushioning material having an uncompressed thickness of between about 2 to about 7 millimeters sufficient to conform to the geometry of fingers and hand of a user to provide enhance stability of grip and to distribute the pressure across an area having a width of a normal adult human hand;

(b) a top and a bottom sheet of a flexible fabric, each sheet being substantially square and planar complementary to the shape of the cushioning material and each sheet being peripherally secured to each other with said cushioning material secured at least peripherally therebetween;

(c) a top strip, comprising pressure actuated securement and detachment means, having a width of about 1 to about 3.5 centimeters secured to said top sheet of fabric along one entire edge thereof;

(d) a bottom strip, also comprising pressure-actuated securement and detachment means, generally complemental in width to said top strip, said bottom strip secured to said bottom sheet of fabric along an edge thereof opposite to said one edge at which said top strip is secured, in which said respective sheets edges define a distance therebetween of between about 12 to about 17 centimeters;

(e) a transparent envelope of a rectangular shape having a long side and a short side, secured at three edges thereof to said bottom sheet with a long side of said envelope being aligned in parallel with said top and bottom strips, thereby providing one edge thereof into which may be inserted an identification or notice of a type desired by a user; and (f) a graphic on said top sheet proving a means of luggage identification, notice of cultural affiliation, advertising space, or artistic expression.

9. The handle cover as recited in claim 8, in which said flexible fabric comprises a polyester denier in a range of between about 400 to about 800.

10. The handle cover as recited in claim 9, in which said cushioning material comprises a polyurethane foam.

11. The handle cover as recited in claim 10, in which said polyurethane foam has a density of between about 10 to about 20 mg/cc.

12. The handle cover as recited in claim 11, in which each of said press-actuated securement means comprise hook-and-loop means.

* * * * *